US008181471B2

(12) United States Patent
Heger et al.

(10) Patent No.: US 8,181,471 B2
(45) Date of Patent: May 22, 2012

(54) ICE-MAKING MACHINE

(75) Inventors: Bernd Heger, Haunsheim (DE); Thomas St Quintin, London (GB); Craig Duncan Webster, Cambridgeshire (GB); Nathan Wrench, Cambridge (GB)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 722 days.

(21) Appl. No.: 11/795,589

(22) PCT Filed: Nov. 29, 2005

(86) PCT No.: PCT/EP2005/056296

§ 371 (c)(1), (2), (4) Date: Jul. 22, 2008

(87) PCT Pub. No.: WO2006/076976

PCT Pub. Date: Jul. 27, 2006

(65) Prior Publication Data

US 2009/0126391 A1 May 21, 2009

(30) Foreign Application Priority Data

Jan. 24, 2005 (DE) ..... 10 2005 003 238

(51) Int. Cl.
*F25C 1/00* (2006.01)
*F25C 5/18* (2006.01)

(52) U.S. Cl. ..... 62/137; 62/344; 62/353

(58) Field of Classification Search ..... 62/137, 62/344, 353

See application file for complete search history.

(56) References Cited

U.S. PATENT DOCUMENTS

| | | | | |
|---|---|---|---|---|
| 2,493,900 | A | 1/1950 | Schaberg et al. | |
| 2,941,379 | A | 6/1960 | Nelson | |
| 2,968,168 | A | 1/1961 | Lippincot | |
| 3,071,933 | A | 1/1963 | Shoemaker | |
| 3,180,103 | A | 4/1965 | Frohbieter | |
| 3,182,468 | A | 5/1965 | Archer | |
| 3,200,612 | A | 8/1965 | Frohbieter | |
| 3,254,505 | A | 6/1966 | DeTurk | |
| 3,362,181 | A | 1/1968 | Linstromb | |
| 3,383,876 | A | 5/1968 | Frohbieter | |
| 3,618,335 | A | 11/1971 | Toma | |
| 3,727,427 | A * | 4/1973 | Eyman et al. | 62/353 |
| 3,863,461 | A * | 2/1975 | Bright | 62/137 |

(Continued)

FOREIGN PATENT DOCUMENTS

| | | |
|---|---|---|
| CN | 1540268 | 10/2004 |

(Continued)

OTHER PUBLICATIONS

International Search Report PCT\EP2005/056296.

*Primary Examiner* — Frantz Jules
*Assistant Examiner* — Daniel C Comings
(74) *Attorney, Agent, or Firm* — James E. Howard; Andre Pallapies

(57) ABSTRACT

An ice maker comprises a tray (1), which has at least one compartment (4) for molding a piece of ice, a frame (15), in which the tray is mounted to be pivotable about an axis (14), and a motor (22) for driving the pivot movement of the tray, which motor is mounted at the frame (15) to be adjacent to the tray (1) and transversely offset relative to the axis.

26 Claims, 5 Drawing Sheets

U.S. PATENT DOCUMENTS

| | | | | | |
|---|---|---|---|---|---|
| 3,871,189 | A | * | 3/1975 | Ohnishi | 62/353 |
| 3,952,539 | A | | 4/1976 | Hanson et al. | |
| 4,142,378 | A | | 3/1979 | Bright et al. | |
| 4,306,423 | A | | 12/1981 | Webb et al. | |
| 4,628,698 | A | | 12/1986 | Needham et al. | |
| 4,852,359 | A | | 8/1989 | Manzotti | |
| 4,923,494 | A | * | 5/1990 | Karlovits | 62/73 |
| 5,329,786 | A | * | 7/1994 | Willis et al. | 62/353 |
| 5,408,844 | A | * | 4/1995 | Stokes | 62/351 |
| 5,582,754 | A | | 12/1996 | Smith et al. | |
| 5,768,899 | A | * | 6/1998 | Lee et al. | 62/137 |
| 5,881,563 | A | * | 3/1999 | Lee et al. | 62/71 |
| 5,992,167 | A | | 11/1999 | Hill et al. | |
| 6,067,806 | A | | 5/2000 | Park | |
| 6,112,540 | A | * | 9/2000 | Serrels et al. | 62/351 |
| 6,148,620 | A | * | 11/2000 | Kumagai et al. | 62/72 |
| 6,314,745 | B1 | | 11/2001 | Janke et al. | |
| 6,414,301 | B1 | | 7/2002 | Borg, Jr. et al. | |
| 6,571,567 | B2 | | 6/2003 | An et al. | |
| 6,637,217 | B2 | * | 10/2003 | Kim et al. | 62/125 |
| 6,658,869 | B1 | | 12/2003 | Thornbrou | |
| 6,945,057 | B2 | * | 9/2005 | Hwang et al. | 62/73 |
| 2004/0177638 | A1 | | 9/2004 | Onishi et al. | |
| 2004/0237564 | A1 | | 12/2004 | Zevlakis | |

FOREIGN PATENT DOCUMENTS

| | | |
|---|---|---|
| DE | 26 48 177 | 4/1978 |
| JP | 5-280848 | 10/1993 |
| JP | 6-273014 | 9/1994 |
| JP | 7-19685 | 1/1995 |

* cited by examiner

ICE-MAKING MACHINE

The present invention relates to an ice maker comprising a tray, which has at least one compartment for moulding a piece of ice, a frame, in which the tray is mounted to be pivotable about an axis, and a motor for driving the pivot movement of the tray. Various ice makers of this kind are known from, for example, U.S. Pat. No. 6,571,567 B2.

BACKGROUND OF THE INVENTION

In these known ice makers the motor is in each instance arranged on the pivot axis. A problem of ice makers of that kind is the space which they need for pivoting the tray. This space has to be available in the refrigerating appliance in which such an ice maker is installed. The larger the dimensions of the tray transversely to the pivot axis, the more difficult it is to provide sufficient space, so that the tray can pivot for ejecting the finished pieces of ice without, for example, hitting against a fresh water feed duct, an adjacent wall of the refrigerating appliance, a collecting container for the pieces of ice or the content thereof, etc.

This generally obliges a constructional form of the tray and the entire ice maker elongated in the direction of the pivot axis. A collecting container for the pieces of ice with sufficient holding capacity must, if its support area is not to be larger than that of the frame, have a considerable height. This makes it difficult to accommodate the ice maker inclusive of collecting container in a refrigerating appliance. If there is allowed a support area of the collecting container which is wider than that of the frame carrying the tray and the motor then the space above the collecting container can be utilised only incompletely.

SUMMARY OF THE INVENTION

The object of the invention is to indicate an ice maker which is of compact construction and thereby easy to insert in a refrigerating appliance.

The object is fulfilled in that in the case of a refrigerating appliance of the kind stated in the introduction the motor is mounted at the frame adjacent to the tray and offset transversely to the axis.

A box extending adjacent to the tray can be used, apart from accommodating the motor, conveniently also for an electronic control system which controls the ice making, for example, in dependence on time and/or on the basis of a detected ice quantity in the collecting container.

The tray is preferably pivotable between an upright setting in which the opening of the compartment is directed upwardly and water can freeze in the compartment and an emptying setting in which the opening of the compartment (4) faces downwardly so that a finished piece of ice can drop out.

The space requirement for movement of the tray can be kept small if the tray is driven merely in oscillatory manner instead of describing a complete revolution about its axis.

In order to nevertheless be able to use an economic, unidirectional motor there is preferably provided a transmission which couples the motor to the tray and converts rotational movement into an oscillating movement.

A piece of ice can be removed in particularly simple manner from a compartment with a cross-section in the shape of a segment of a circle in that the piece of ice slides in circumferential direction of the segment of the circle without, as in the case of a conventional block-shaped piece of ice of the type under consideration in, for example, U.S. Pat. No. 6,571,567 B2, formation, during removal from the mould, between the base of the compartment and the ice body a cavity which prevents removal from the mould as long as there is no equalisation of an underpressure prevailing in the cavity.

An electric heating device can be provided at the ice-maker tray in order to accelerate and facilitate removal from the mould of finished pieces of ice by surface thawing.

In order to achieve an intensive heat exchange with the environment the tray can be provided with protruding heat exchange ribs. These ribs can at the same time serve for mounting a rod-shaped heating device inserted therebetween.

It is also advantageous that the tray has at least one row of several compartments separated by partition walls and is pivotable into a tilted setting in which a predetermined quantity of water filled into a row of the tray (1, 1', 1") in part floods over the upper edges of the partition walls (3) between the compartments (4) of the row, whilst after pivotation back into the upright setting the partition walls (3) separate the part quantities, which are distributed to the compartments (4), of the water quantity from one another. This makes it possible to equalise the water level between the compartments in the tilted setting and thereby produce standardised pieces of ice.

If the tilted setting and the emptying setting are reachable from the upright setting by pivotation in opposite directions, the entire cycle of ice production can elapse in the course of an easily controllable movement, in the same sense, of the tray, from the equalisation in the tilted setting through the freezing in the upright setting to the mould removal in the emptying setting.

DETAILED DESCRIPTION OF THE EXEMPLARY EMBODIMENTS OF THE PRESENT INVENTION

Figure 1:
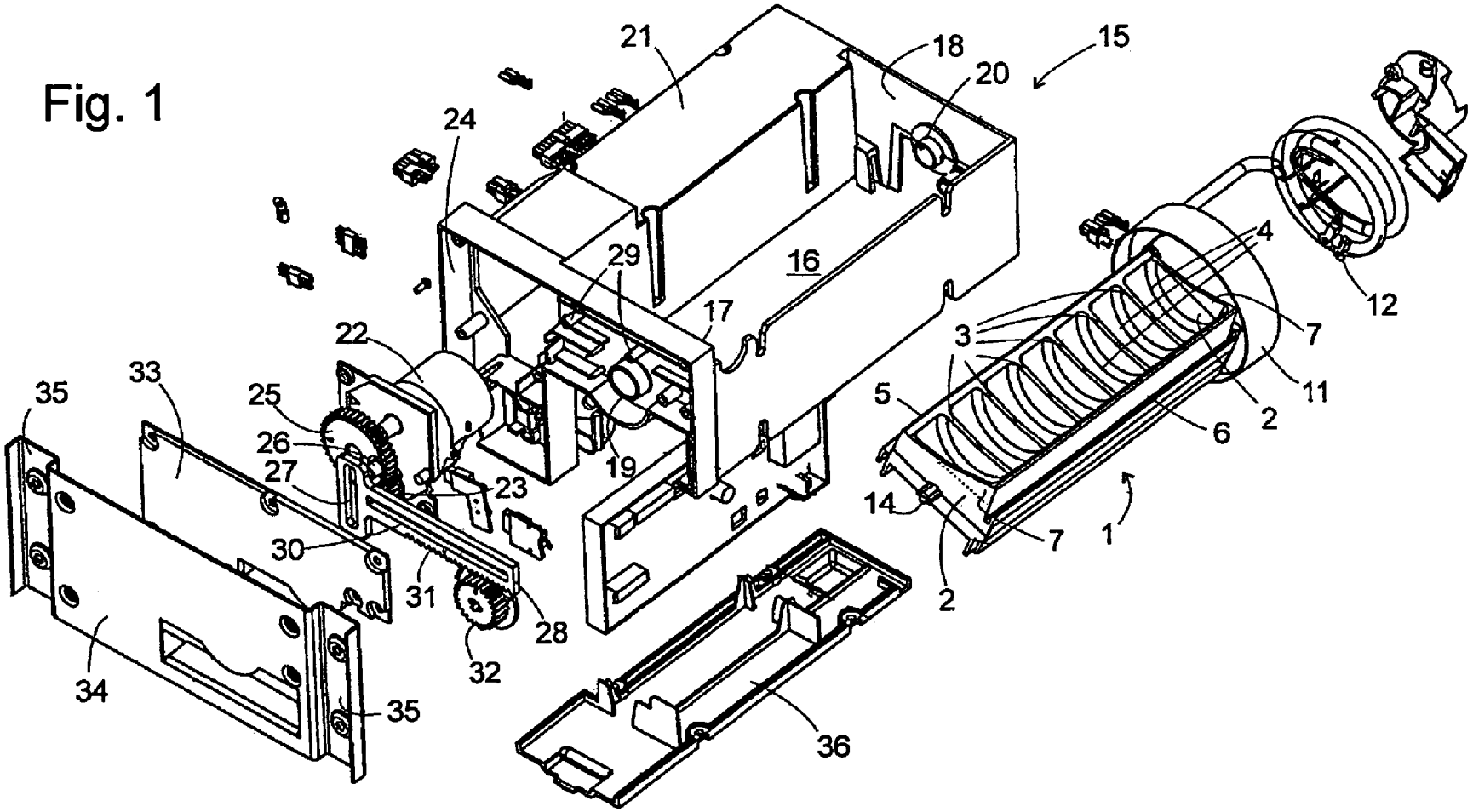
FIG. 1 shows an exploded illustration of an automatic ice maker according to a preferred embodiment of the invention.

FIG. 1 shows an automatic ice cube maker according to the present invention in an exploded perspective view. It comprises a tray 1 in the form of a channel with a semi-cylindrical base, which is closed at its ends by respective transverse walls 2 and is divided by partition walls 3, which are arranged at uniform spacings, into a plurality of identically shaped compartments 4, here seven units, with a semi-cylindrical base. Whereas the partition walls 3 at the longitudinal wall 5 remote from the viewer adjoin flushly, the longitudinal wall 6 facing the viewer is prolonged above the upper edges of the partition walls 3. Whilst the partition walls 3 are exactly semicircular, the transverse walls 2 each have a sector 7, which goes out above the semicircular shape, in correspondence with the protrusion of the front longitudinal wall 6.

The tray 1 is shown in a tilted setting in which the upper edges of the segments 7 extend substantially horizontally, whilst those of the partition walls 3 are inclined towards the longitudinal wall 6.

The tray 1 can be a plastics material moulded part, but preferably, due to the good capability of thermal conductance, it is constructed as a cast part of aluminium.

Figure 9:
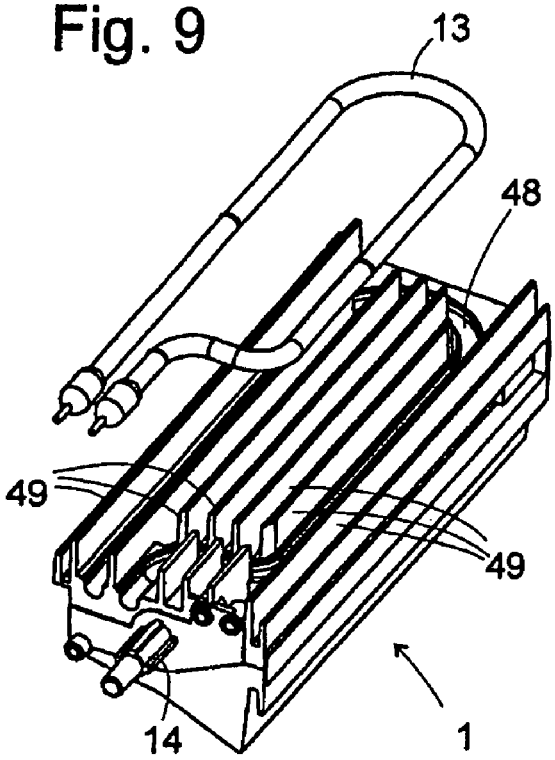
FIG. 9 shows a perspective exploded view from below of the ice-maker tray.

A hollow cylinder 11 is mounted at one of the transverse walls 2 of the tray 1; it serves for protected accommodation of a coiled power supply cable 12 serving for supply of current to a heating device 13, which is not visible in the figure, accommodated at the underside of the tray 1 (see FIG. 9). The tray 1 lies completely within a notional prolongation of the circumferential surface of the hollow cylinder 11, which at the same time represents the smallest possible cylinder into which the tray fits. An axial spigot 14, which protrudes from the transverse wall 2 facing the viewer, extends on the longitudinal centre axis of the hollow cylinder 11.

A frame serving as a mount and moulded from plastics material is denoted by 15. It has an upwardly and downwardly open cavity 16 which is provided for mounting of the tray 1 therein. Bearing bushes 19, 20 for the pivotable mounting of the tray 1 are formed at the end walls 17, 18 of the cavity 16. A longitudinal wall of the cavity 16 is formed by a box 21 serving as a receptacle, which is provided for reception of a drive motor 22 as well as various electronic components for control of operation of the ice maker. Mounted on the shaft of the drive motor 22 is a pinion 23 which can be seen better in each of FIGS. 3, 4, 6 and 8 than in FIG. 2. When the ice maker is in fully mounted state the pinion 23 finds space in a cavity 24 of the end wall 17. It forms there, together with a gearwheel 25, a speed step-down transmission.

The gearwheel 25 carries a pin 26 which protrudes in axial direction and which is provided for engaging in a vertical slot 27 of an oscillatory body 28. The oscillatory body 28 is guided to be horizontally displaceable with the help of pins 29 which protrude from the end wall 17 into the cavity 24 and which engage in a horizontal slot 30 of the oscillatory body. A toothing 31 formed at a lower edge of the oscillatory body 28 meshes with a gearwheel 32, which is provided for the purpose of being plugged onto the axial spigot 14 of the tray 1 to be secure against rotation relative thereto.

A cover plate 33 screw-connected to the open side of the end wall 17 closes the cavity 24. A fastening flange 34 with straps 35 protruding laterally beyond the end wall 17 serves for mounting the ice maker in a refrigerating appliance. A base plate 36 closes the box 21 at the bottom.

Figure 2:
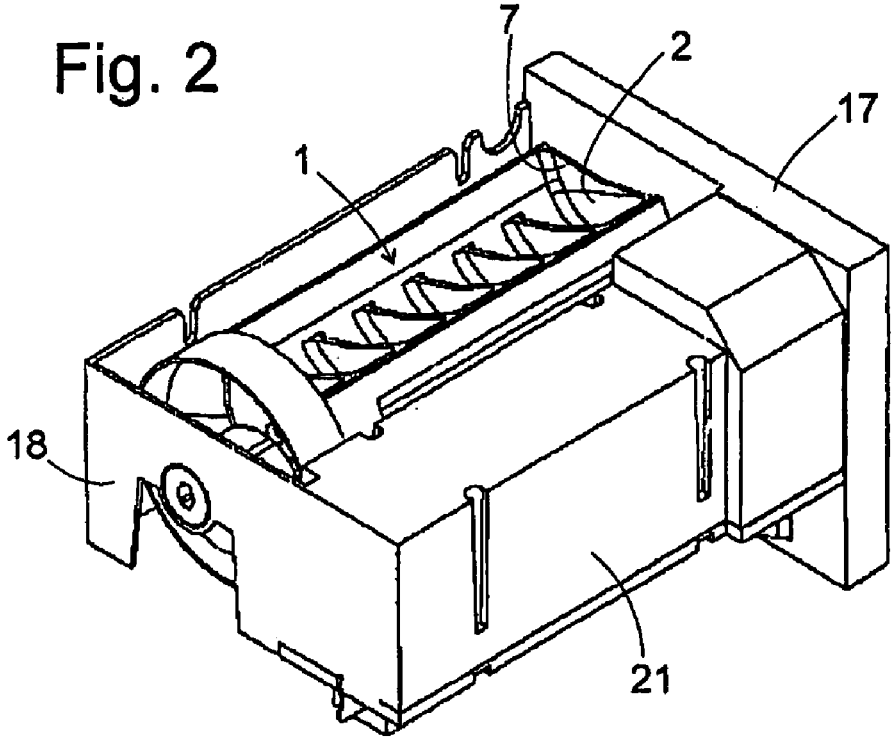
FIG. 2 shows a perspective view of the ice maker according to FIG. 1 in assembled state with ice-maker tray in tilted setting.

FIG. 2 shows, as seen from the side of the end wall 18 and the box 21, the ice maker with the tray 1 in tilted setting in perspective view. The upper edges of the sectors 7 at the transverse walls 2 of the tray 1 extend horizontally.

Figure 3:
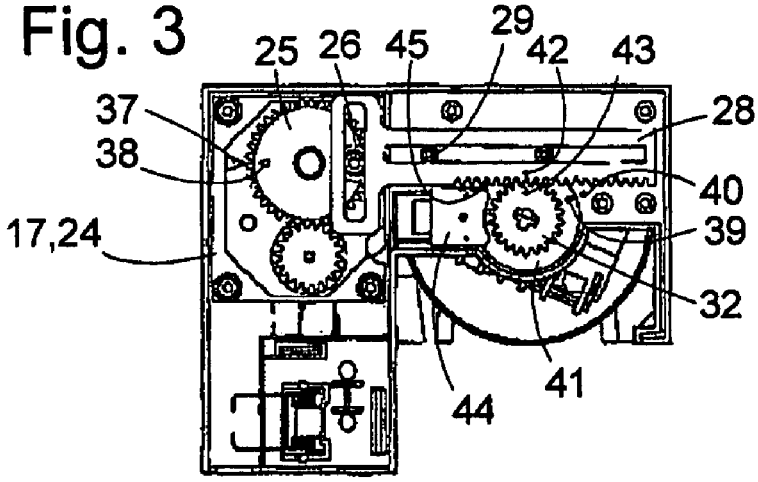
FIG. 3 shows a front view of the ice maker of FIG. 1 or 2 in the direction of the pivot axis.

FIG. 3 shows a front view of the ice maker from the side of the end wall 17, wherein cover plate 33 and fastening flange 34 have been omitted in order to give free view into the cavity 24 of the end wall 17. The configuration shown here is that in which the ice maker is mounted together. Various markings indicate a correct positioning of individual parts relative to one another. A first pair of markings 37, 38 is disposed at the end wall 17 itself, or at the gearwheel 25 carrying the pin 26. When these markings 37, 38 are, as shown in the figure, aligned exactly with one another the pin 26 is disposed in a 3 o'clock setting, i.e. on the point, which lies furthest to the right in the perspective view of the figure, of its path which it can reach. The oscillatory body 28 plugged onto the pin 26 as well as onto the stationary pin 29 is disposed at the righthand reversal point of its path.

Markings 39, 40, which are aligned with one another, at a flange 41 of the gearwheel 32 protruding beyond the tooth rim and at the end wall 17 indicate a correct orientation of the gearwheel 32 and as a consequence thereof also of the tray 1 engaging by its axial spigot 14 in a cut-out, which is T-shaped in cross-section, of the gearwheel 32. A pair, which is redundant per se, of markings 42, 43 at the toothing 31 of the pivot body 28 and at the gearwheel 32 shows the correct positioning of gearwheel 32 and oscillatory body 31 with respect to one another.

Figure 4:
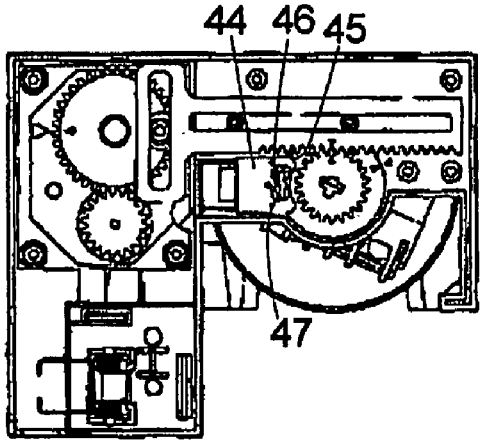
FIG. 4 shows the view of FIG. 3 with partly cut-away sensor housing.

A sensor 44 for detecting the rotational setting of the gearwheel 32 is mounted near this. It co-operates with a rib 45, which protrudes in axial direction from the edge of the flange 41 on a part of the circumference thereof so that it can enter into a slot at the rear side of the sensor housing. In the tilted setting of FIG. 3 the rib is covered for the greatest part by the sensor 44 and the oscillatory body 28. FIG. 4 differs from FIG. 3 in that the housing of the sensor 44 is shown in part cut away so that two light barriers 46, 47 bridging over the slot can be recognised in its interior. The rib 45 is disposed closely above the two light barriers 46, 47 so that a control electronic system, which is not illustrated, can recognise, on the basis of the fact that the two light barriers are open, that the tray 1 is disposed in the tilted setting and can stop the drive motor 22 in order to be able to keep the tray 1 in the tilted setting and fill it.

Figure 5:
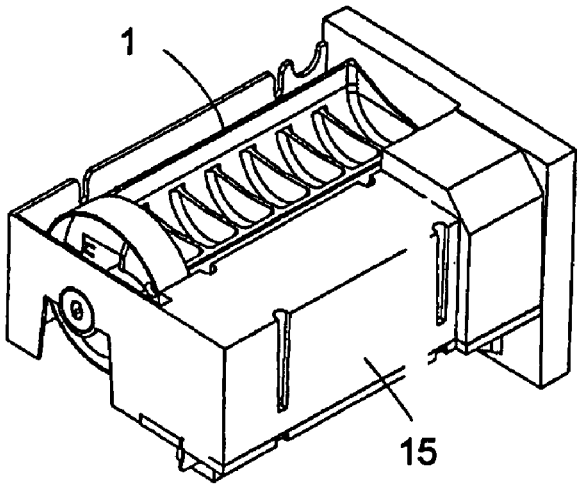
FIG. 5 shows a view, which is analogous to FIG. 2, with ice-maker tray in upright setting.
Figure 6:
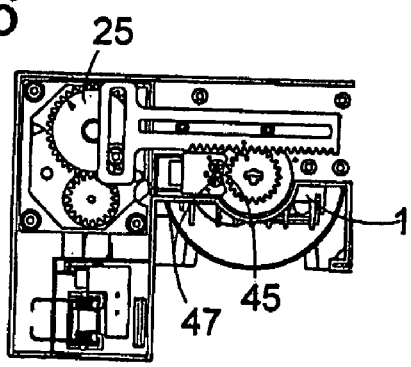
FIG. 6 shows a view, which is analogous to FIG. 4, with the ice-maker tray in upright setting.

After a predetermined water quantity has been admetered to the tray 1 under the control of the control circuit the drive motor 22 is set in operation by the control unit in order to bring the tray 1 into the upright setting in which the water quantities in the compartments 4 of the tray 1 are cleanly separated from one another. This setting is shown in FIG. 5 in a perspective view corresponding with FIG. 2 and in FIG. 6 in a front view corresponding with FIG. 4. The gearwheel 25 is further rotated in clockwise sense relative to the setting of FIG. 4, although the same setting of the tray 1 can also be reached by rotation of the gearwheel 25 in counter-clockwise sense. Attainment of the upright setting is recognised when the rib 45 begins to block the lower light barrier 47.

The tray 1 remains in the upright setting for such a length of time until the water in the compartments 4 is frozen. The dwell time in the upright setting can be fixedly predetermined; alternatively, the control circuit can also be connected with a temperature sensor in order to be able to establish, on the basis of a measured temperature in the environment of the tray 1 and a characteristic curve stored in the control circuit, a respective time period sufficient in the case of the measured temperature for freezing the water.

Figure 8:
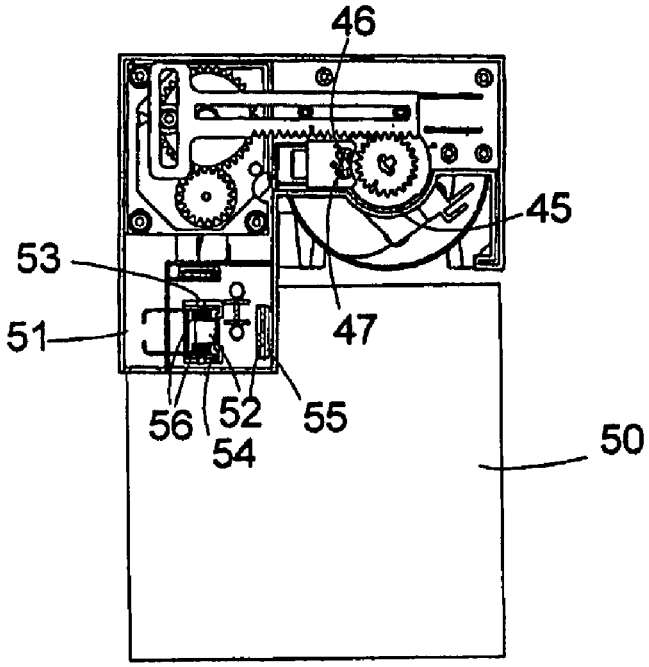
FIG. 8 shows a view analogous to FIG. 4 or 6.

After expiry of this time period the drive motor 22 is set back into operation in order to rotate the gearwheel 25 into the setting shown in FIG. 8, with the pin 26 in the 9 o'clock position. The control circuit recognises that this position is reached when the two light barriers 46, 47 are again open. The rib 45 is now able to be clearly seen in the figure for a major part of its length.

In this setting the compartments 4 of the tray 1 are open downwardly so that the pieces of ice contained therein can fall into a storage chamber disposed underneath the frame 15. The storage chamber can be bounded by a housing part, which is not illustrated in the figures, of the ice maker; in the simplest and preferred case, the storage chamber is merely a free space below the installation position of the frame 15 in a refrigerating appliance. Such a free space can, if the ice maker is not in operation, also be used for storage of stock, which is to be cooled, different from pieces of ice.

In order to facilitate release of the pieces of ice from the compartments 4, the already mentioned electric heating device 13 is provided. As can be recognised in FIG. 9, this heating device 13 is an electric heating rod which is bent into a loop and which extends in close contact with the tray 1 through between heat exchange ribs 49 protruding from the underside thereof and is in part received in a groove 48 formed at the underside of the tray 1.

The pieces of ice in the compartments 4 are thawed at the surface by brief heating of the tray 1 with the help of the heating device 13. The water layer thus produced between the tray 1 and the pieces of ice acts as a slide film on which the pieces of ice are movable with very low friction. By virtue of the cross-sectional shape of the compartments 4 as a segment of a cylinder the pieces of ice easily slide out of the compartments 4 and drop into a collecting container 5 arranged in the storage chamber below the frame 15.

After emptying of the compartments 4 the drive motor is set back into operation and the gearwheel 25 further rotated in clockwise sense until it again reaches the setting shown in FIGS. 2 to 4 and a new operating cycle of the ice maker begins.

Figure 7:
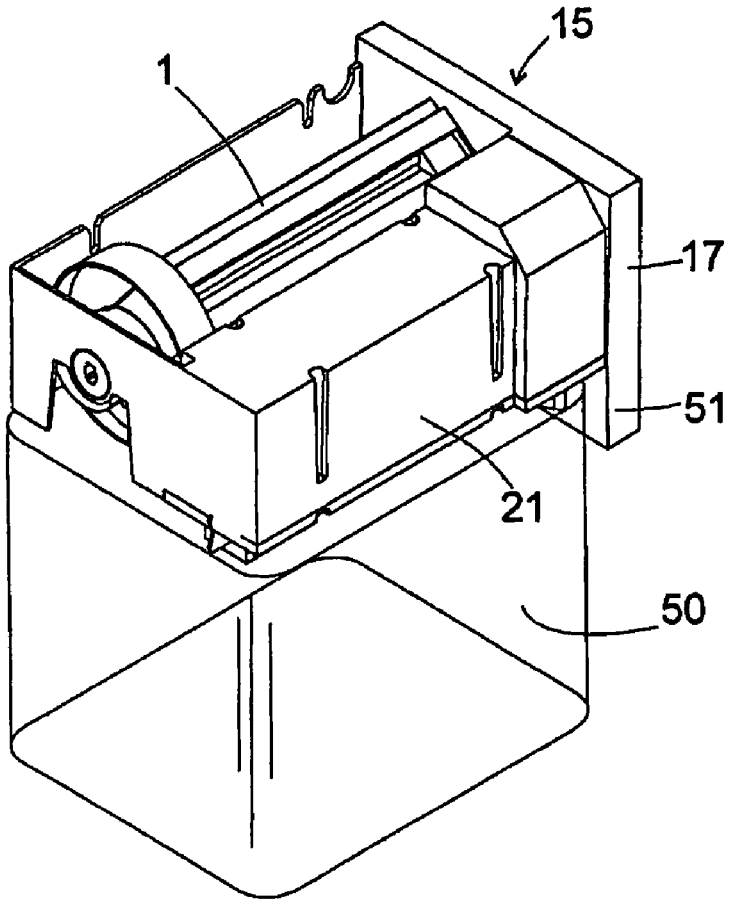
FIG. 7 shows a perspective view analogous to FIGS. 2 and 5 with the ice-maker tray in emptying setting.

The collecting container 50 formed from glass-clear plastics material has, as shown in FIG. 7, substantially the form of a block, the open upper side of which extends under the entire length of the frame 15 with the exception of the hollow end wall 17 thereof. This end wall 17 has a downwardly directed projection 15 which reaches to below the upper edge of the storage container 50. A detection body 52, which in FIG. 7 is covered by the box 21 of the frame 15, is suspended at this projection 51 to be pivotable about a vertical axis 53. The detection body 52 is covered, in the perspective view of FIG. 8, for the greatest part by the outer surface, which faces the storage container 50, of the projection 51. Parts of the detection body 52 are to be seen merely through two windows 54, 55 of the outer wall. A helical spring 56 is coiled around the axis 53 of the detection body 52 and has free ends engaging at the outer wall of the projection 51. The spring 56 holds the detection body 52 pressed against the side wall of the storage container 50.

The detection body 52 is part of a multi-purpose sensor, the construction and function of which is clearer on the basis of FIGS. 10 to 14.

Figure 10:
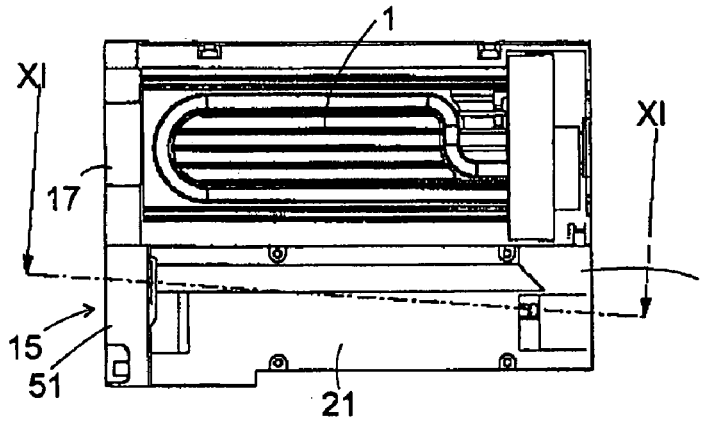
FIG. 10 shows a view of the ice maker from below.
Figure 12:
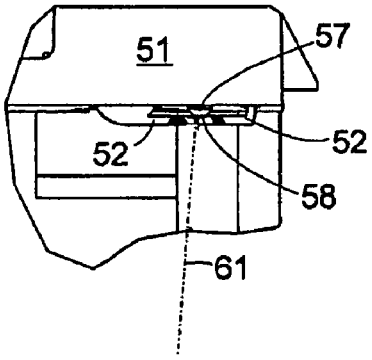
FIG. 12 shows an enlarged detail of FIG. 11, partly in section along the line T-T of FIG. 11.

FIG. 10 shows a view of the frame 15 and the tray 1 suspended therein from below, wherein the tray is disposed in a setting corresponding with FIG. 5. A line XI-XI drawn obliquely over the box 21 of the frame 15 indicates the position of the section planes of FIGS. 11 and 13.

Figure 11:
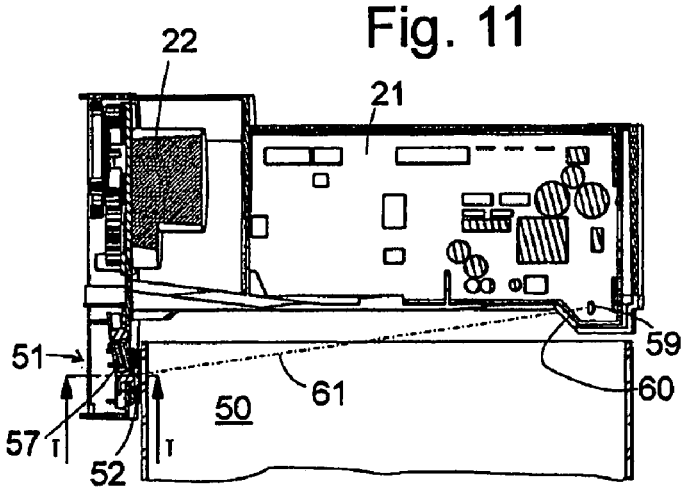
FIG. 11 shows a section through the ice maker along the line XI-XI of FIG. 10, with detection body in deflected position.
Figure 14:
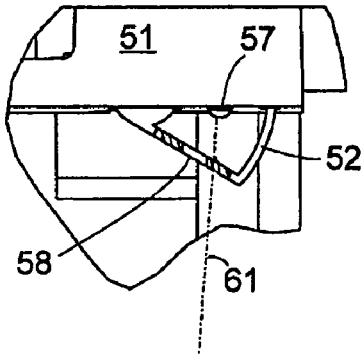
FIG. 14 shows an enlarged detail of FIG. 13, partly in section along the line T-T of FIG. 13.

The motor 22 and parts of the transmission for driving the pivot movement of the tray 1 can be seen in the section of FIG. 11. Disposed below the transmission are a projection 51 with a side wall 17 of the detection body 52 and, partly surrounded by this, a light-emitting diode 52 emitting in the infrared or visible range.

The detection body 52 is pressed by the side wall, which bears thereagainst, of the storage container 50 against the force of the spring 56 into a deflected position in which it enters for the major part into the hollow side wall 17. In this position, as can be seen more clearly in the detail enlargement—which is partly sectioned along the plane T-T of FIG. 11—in FIG. 12, a window 58 of the detection body 52 lies on a straight line between the light-emitting diode 57 and an element 59, such as, for example, a photodiode, sensitive to the light of the light-emitting diode 57, the element 59 being accommodated in the box 21 at a side opposite the wall 17 and being oriented through a window 60 in an inclined wall at the underside of the box 21 onto the light-emitting diode 57. Thus, light from the light-emitting diode 57 can reach the photodiode 59 on a beam path 61 shown in FIG. 11 as a dot-dashed line.

The ice maker operates only when the light intensity received by the photodiode 59 exceeds a predetermined threshold. If a piece of ice is disposed on the beam path 61 between the light-emitting diode 57 and the photodiode 59 in the storage container 50 the light is scattered to such an extent that the threshold is fallen below at the diode 59. Further production of ice is thus inhibited when the filling state in the storage container 50 reaches up to the beam path 61. Since this beam path 61 runs, on a part of its length, under the upper edge of the storage container 50 the ice making is reliably stopped before the storage container 50 can overflow.

Figure 13:
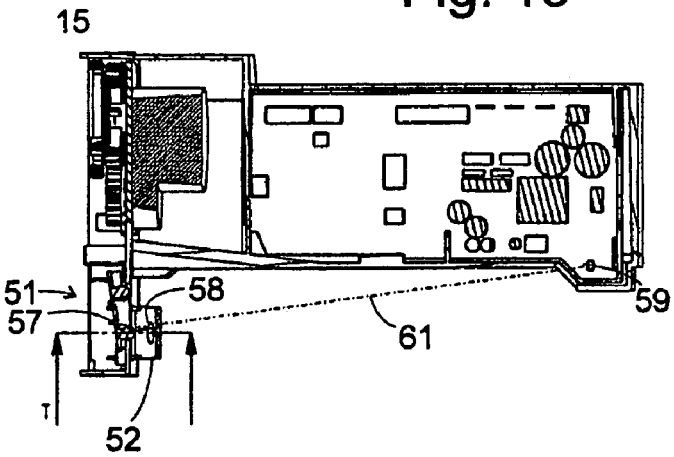
FIG. 13 shows a section through the ice maker along the line XI-XI of FIG. 10, with detection body in equilibrium position.

FIG. 13 shows a section, which is analogous to FIG. 11, through the frame 15, wherein, however, here the storage container 50 is removed. In this case the detection body 52 can yield to the pressure of the spring 56 and travels out of its equilibrium setting which is shown in FIG. 13 and, enlarged, in FIG. 14.

In this equilibrium setting the window 58 no longer lies in the beam path 61, so that the detection body 52 blocks the light beam. Therefore, if the storage container 50 is not present, an insufficient light intensity arrives at the photodiode 59 and the ice making is similarly stopped.

The invention claimed is:

1. An ice maker comprising:

a tray having at least one compartment for molding a piece of ice;

a mount in which the tray is mounted to be pivotable about an axis; and a motor for driving the pivot movement of the tray, wherein the motor is arranged at the mount and disposed laterally alongside a longitudinal wall of the tray when the tray is in an upright setting and offset transversely to the axis;

wherein the upright setting is a setting in which all openings of the at least one compartment are directed upward.

2. The ice maker according to claim 1, wherein the motor is provided in a first longitudinal third portion of the mount.

3. The ice maker according to claim 1, wherein the mount has a receptacle which extends adjacent to the tray and in which the motor and an electronic control system for controlling operation of the motor are arranged.

4. The ice maker according to claim 3, wherein the electronic control system comprises a sensor for detecting the presence of at least one of ice and a collecting container for ice below the mount.

5. The ice maker according to claim 1, wherein the tray is pivotable between the upright setting, in which an opening of the compartment is directed upwardly, and an emptying setting, in which the opening of a compartment faces downwardly.

6. The ice maker according to claim 5, wherein the tray is driven to oscillate.

7. The ice maker according to claim 6, wherein the motor is unidirectional and is coupled to the tray by a transmission converting rotational movement into an oscillating movement.

8. The ice maker according to claim 7, wherein the transmission converting rotational movement into the oscillating movement includes:

an oscillating body having a vertical slot, a horizontal slot, and a toothing at a lower edge of the oscillating body;

a first gear wheel coupled to a shaft of the motor, the first gear wheel including a pin engaging the vertical slot of the oscillating body;

a second gear wheel coupled to the tray, the second gear meshing with the toothing at the lower edge of the oscillating body; and a guide pin protruding from a transverse wall of the mount, the guide pin engaging the horizontal slot of the oscillating body such that the oscillating body is guided to be horizontally displaceable, wherein the oscillating body extends in a direction transverse to the axis of the tray and is adjacent to the transverse wall of the mount.

9. The ice maker according to claim 8, wherein the tray has at least one row of several compartments separated by partition walls and is pivotable by the transmission into a tilted setting, in which a predetermined quantity of water filled into a row of the tray in part floods over upper edges of the partition walls between the compartments of the row, and wherein after the transmission pivots the tray back into the upright setting the partition walls separate the part quantities of the water quantity from one another which are distributed to the compartments.

10. The ice maker according to claim 9, wherein the transmission pivots the tray in a first direction from the upright setting to reach the tilting setting and pivots the tray in a second direction from the upright setting to reach the emptying setting.

11. The ice maker according to claim 5, wherein the tray has at least one row of several compartments separated by partition walls and is pivotable into a tilted setting, in which a predetermined quantity of water filled into a row of the tray in part floods over upper edges of the partition walls between the compartments of the row, wherein after pivoting back into the upright setting the partition walls separate the part quantities of the water quantity from one another which are distributed to the compartments.

12. The ice maker according to claim 11, wherein the tilting setting and the emptying setting are reachable from the upright setting by pivoting in opposite directions.

13. The ice maker according to claim 5, wherein an axis of rotation of a shaft of the motor is parallel to the axis of the tray and offset transversely to the axis of the tray, and wherein the axis of rotation of the shaft of the motor is adjacent to the longitudinal wall of the tray when the tray is in the upright setting.

14. The ice maker according to claim 1, wherein the compartment has the form of a segment of a circle in cross-section.

15. The ice maker according to claim 1, further comprising an electric heating device.

16. The ice maker according to claim 1, wherein an axis of rotation of a shaft of the motor is parallel to the axis of the tray and offset transversely to the axis of the tray.

17. The ice maker according to claim 1, wherein the mount has a longitudinal wall extending adjacent to the longitudinal wall of the tray.

18. The ice maker according to claim 17, wherein the longitudinal wall of the mount forms a wall of a receptacle extending adjacent to the tray, and wherein the motor and an electronic control system for controlling operation of the motor are arranged in the receptacle.

19. The ice maker according to claim 1, wherein the motor is disposed adjacent to and laterally alongside the longitudinal wall of the tray.

20. The ice maker according to claim 1, wherein the mount has a longitudinal wall extending adjacent to and laterally alongside the longitudinal wall of the tray when the tray is in the upright setting.

21. The ice maker according to claim 20, wherein the longitudinal wall of the mount forms a wall of a receptacle, the receptacle extending adjacent to and laterally alongside the tray, and wherein the motor and an electronic control system for controlling operation of the motor are arranged in the receptacle.

22. The ice maker according to claim 1, wherein the mount includes a receptacle extending adjacent to and laterally alongside the tray when the tray is in the upright setting, and wherein the motor and an electronic control system for controlling operation of the motor are arranged in the receptacle.

23. An ice maker comprising:

a tray having at least one compartment for molding a piece of ice, the tray being pivotable between an upright setting in which all openings of the at least one compartment are directed upward and an emptying setting in which the openings face downwardly;

a mount in which the tray is mounted to be pivotable about an axis; and a motor for driving the pivot movement of the tray, wherein the tray includes a longitudinal wall extending in a direction of the axis, and wherein the motor is arranged at the mount and disposed laterally alongside the longitudinal wall of the tray when the tray is in the upright setting.

24. The ice maker according to claim 23, wherein the mount includes a receptacle extending adjacent to and laterally alongside the tray when the tray is in the upright setting, and wherein the motor and an electronic control system for controlling operation of the motor are arranged in the receptacle.

25. The ice maker according to claim 23, wherein the mount has a longitudinal wall extending adjacent to and laterally alongside the longitudinal wall of the tray when the tray is in the upright setting.

26. The ice maker according to claim 25, wherein the longitudinal wall of the mount forms a wall of a receptacle extending adjacent to the tray, and wherein the motor and an electronic control system for controlling operation of the motor are arranged in the receptacle.

* * * * *